US007104810B2

(12) United States Patent
Kawakita et al.

(10) Patent No.: US 7,104,810 B2
(45) Date of Patent: Sep. 12, 2006

(54) ELECTRICAL CONNECTION BOX

(75) Inventors: Shinji Kawakita, Mie (JP); Shigeki Yamane, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/194,620

(22) Filed: Aug. 2, 2005

(65) Prior Publication Data

US 2006/0030213 A1 Feb. 9, 2006

(30) Foreign Application Priority Data

Aug. 3, 2004 (JP) ..... P2004-227145
Jan. 6, 2005 (JP) ..... P2005-001575

(51) Int. Cl.
*H01R 12/00* (2006.01)

(52) U.S. Cl. ..... 439/76.2; 439/248

(58) Field of Classification Search ..... 439/76.1, 439/76.2, 79, 247, 248, 709, 949
See application file for complete search history.

(56) References Cited

U.S. PATENT DOCUMENTS 6,948,950 B1 * 9/2005 Yamaguchi ..... 439/76.2
6,962,499 B1 * 11/2005 Yamamoto et al. ..... 439/76.2
6,971,888 B1 * 12/2005 Takeuchi et al. ..... 439/76.2
7,014,478 B1 * 3/2006 Yamashita et al. ..... 439/76.2
7,033,186 B1 * 4/2006 Kawakita et al. ..... 439/76.2
7,037,124 B1 * 5/2006 Lee et al. ..... 439/157

FOREIGN PATENT DOCUMENTS

JP A 2000-021477 1/2000

* cited by examiner

*Primary Examiner*—Khiem Nguyen
(74) *Attorney, Agent, or Firm*—Oliff & Berridge, PLC

(57) ABSTRACT

An electrical connection box includes: a case having an opening, the case housing a circuit forming board having a conductive path; a connector being attached to an attachment surface of the case at end side of the opening, the connector being mounted on the circuit forming board; a terminal fitting being attached to the connector and connected to the conductive path of the circuit forming board by soldering; and an attachment member being provided between the attachment surface of the case and the connector. The attachment member allows a displacement of the connector by pressing the connector against an attachment surface of the case.

7 Claims, 14 Drawing Sheets

ELECTRICAL CONNECTION BOX

BACKGROUND OF THE INVENTION

1. Filed of the Invention

The present invention relates to an electrical connection box.

2. Description of the Related Art

Electrical connection boxes with which cars are equipped have been known in JP-A-2000-21477. The Electrical connection boxes are formed by a circuit forming body where a connector for a board is mounted on an end portion of a circuit board in a case. The connector for a board is placed so as to face the outside of the case. In the connector, terminal fittings that have been mounted on a connector housing are connected to conductive paths of the circuit board by flow soldering.

SUMMARY OF THE INVENTION

A force is directly applied to the connector when an opposing connector that has been attached to a terminal of a wire harness is attached and removed. Therefore, the connector can be secured to the case more firmly, and thereby, the holding force of the connector for the board can be enhanced.

The circuit forming body is formed by soldering terminal fittings to the circuit board, and after that, the circuit forming body is included in and secured to the case, and finally, the connector for the board is secured to the case.

However, the connector for the board may be connected to the circuit board at a point shifted from the normal position, for example, at a point away from the circuit board. The connector for a board is secured to the circuit board in a state of being forced into the proximity of the circuit board while elastically changing the form of the terminal fittings. Thus, residual stress remains in the soldered portion, and there is a risk that cracking may occur.

It is an object of the invention to prevent an electrical connection box from being damaged, for example, cracked in the soldered portion.

According to one aspect of the invention, there is provided an electrical connection box including: a case housing a circuit forming board having a conductive path, the case having a first attachment member; a connector being mounted on the circuit forming board, the connector having a second attachment member; and a terminal fitting being attached to the connector and connected to the conductive path of the circuit forming board by soldering. The connector is attached to the case with a clearance with respect to the case by the first and second attachment members.

Even in the case where the connector is connected to the case at a point shifted from the normal position, the connector is attached to the case in a state where this positional shift is within the allowance. In other words, when the connector is attached to the case, the position of the connector is not forced to change, and therefore, the form of the terminal fittings can be prevented from being changed, and no residual stress remains in the soldered portions of the terminal fittings, and damage, such as cracking, can be prevented. Therefore, high reliability can be obtained in the electrical connection between the connector and the circuit forming plate.

According to another aspect of the invention, the first attachment member includes a fitting protrusion. The second attachment member includes a through hole through which the fitting protrusion of the case can pass. A pull-out preventing portion is at an end of the fitting protrusion after the fitting protrusion has been passed through the through hole. The pull-out preventing portion has a diameter that is greater than an inner diameter of the through hole.

According to the above-aspects of the invention, the fitting protrusion is made to pass through the through hole, and after that, the pull-out preventing portion having a diameter that is greater than the inner diameter of the through hole is provided to the end of the fitting protrusion, and thereby, the connector can be attached to the case in a state where there is a clearance in between. In this manner, the connector can be attached to the case in with a simple configuration, with a fitting protrusion, a through hole and a pull-out preventing portion, and thus, the electrical connection box can be miniaturized.

According to another aspect of the invention, the pull-out preventing portion is a head of a screw that has been screwed into an end surface of the fitting protrusion.

According to the above-aspects of the invention, the pull-out preventing portion can be formed using a simple technique where a screw is screwed into the end surface of the fitting protrusion.

According to another aspect of the invention, a screw insertion hole for inserting the screw is formed in the end surface of the fitting protrusion. The screw insertion hole is formed on an area that is substantially as deep as a protrusion height of the fitting protrusion from the end surface of the fitting protrusion. The screw insertion hole has a screw escape portion of which an inner diameter is greater than a maximum outer diameter of the threaded portion of the screw; and a screw hole which is formed at a bottom of the screw escape portion, and in which the screw is screwed.

According to the above-aspects of the invention, the inner diameter of the screw escape part is set at a value that is greater than the maximum outer diameter of the threaded portion of the screw, and therefore, the threaded portion and the inner peripheral surface of the screw escape portion do not make contact. As a result of this, no force is applied to the fitting protrusion from the screw, and thus, cracking of the fitting protrusion when the screw is inserted into the screw insertion hole can be prevented.

According to another aspect of the invention, there is provided an electrical connection box including: a case having an opening, the case housing a circuit forming board having a conductive path; a connector being attached to an attachment surface of the case at end side of the opening, the connector being mounted on the circuit forming board; a terminal fitting being attached to the connector and connected to the conductive path of the circuit forming board by soldering; and an attachment member being provided between the attachment surface of the case and the connector. The attachment member allows a displacement of the connector by pressing the connector against an attachment surface of the case.

Even in the case where the connector is combined with the circuit forming board at a point that is shifted from the normal position, the connector is pressed against and secured to the attachment surface of the case, in a state where the displacement is within the allowance. In other words, when the connector is secured to the attachment surface, the position of the connector is not forced to change, and thus, the form of the terminal fittings can be prevented from being changed. No residual stress remains in the soldered portions of the terminal fittings and damage, such as cracking, can be prevented. Accordingly, high reliability can be obtained in the electrical connection between the connector and the circuit forming plate.

According to another aspect of the invention, the connector includes an attachment plate pressed against the attachment surface of the case. A head of the screw can be engaged with an end of the through hole by screwing a screw into the attachment surface of the case through a through hole that has been opened in the attachment plate. A restriction member for restricting a height of the head of the screw is provided in such a manner that a predetermined clearance is provided between the head of the screw and the end of the through hole, even in case where the screw has been screwed to a maximum.

By thus configuration, the screw is screwed into a through hole of the attachment plate that has been pressed against the attachment surface, and thereby, the attachment plate is secured with the head of the screw that has engaged with the end of the through hole. Here, even in the case where the screw has been fully screwed in, a predetermined clearance is provided between the head of the screw and the end of the through hole, according to the setting, and therefore, even in the case where the connector is connected to the circuit forming plate at a point shifted from the normal position, the displacement is allowed within the clearance. The connector is secured without changing in position.

According to another aspect of the invention, a fitting protrusion where a screw hole for the screw is threaded into an end surface of the fitting protrusion is provided on the attachment surface of the case. The fitting protrusion can be fitted into the through hole that has been opened in the attachment plate of the connector. The head of the screw that is screwed into the screw hole can be engaged with the end of the through hole. A plate thickness of the attachment plate is set at a value to be smaller than the height of the fitting protrusion.

When a screw is screwed into a screw hole, screwing is stopped where the head hits the end surface of the fitting protrusion and the plate thickness of the attachment plate has been set at a value that is smaller than the height of the fitting protrusion, and therefore, a clearance should be provided between the head of the screw and the end of the through hole. As a result, even in the case where the connector is connected to the circuit forming board at a point that is shifted from the normal position, the positional shift is allowed within this clearance, in the same manner as in the above, and the connector is secured without being forced to change in position.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

<Embodiment 1 >

In the following, Embodiment 1 of the present invention is described with reference to FIGS. 1 to 13.

Figure 1:
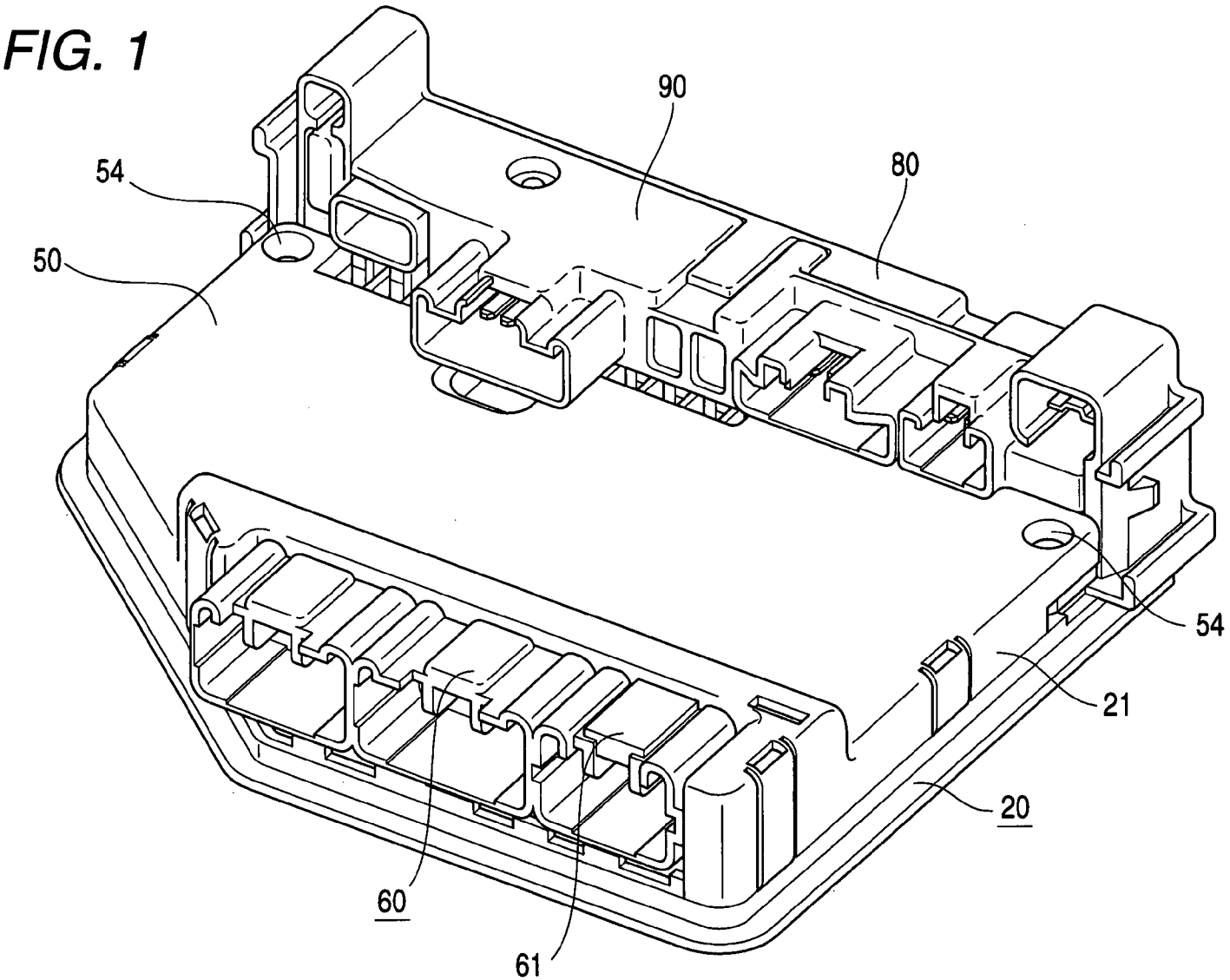
FIG. 1 is a perspective view showing the appearance of an electrical connection box according to Embodiment 1 of the present invention.
Figure 2:
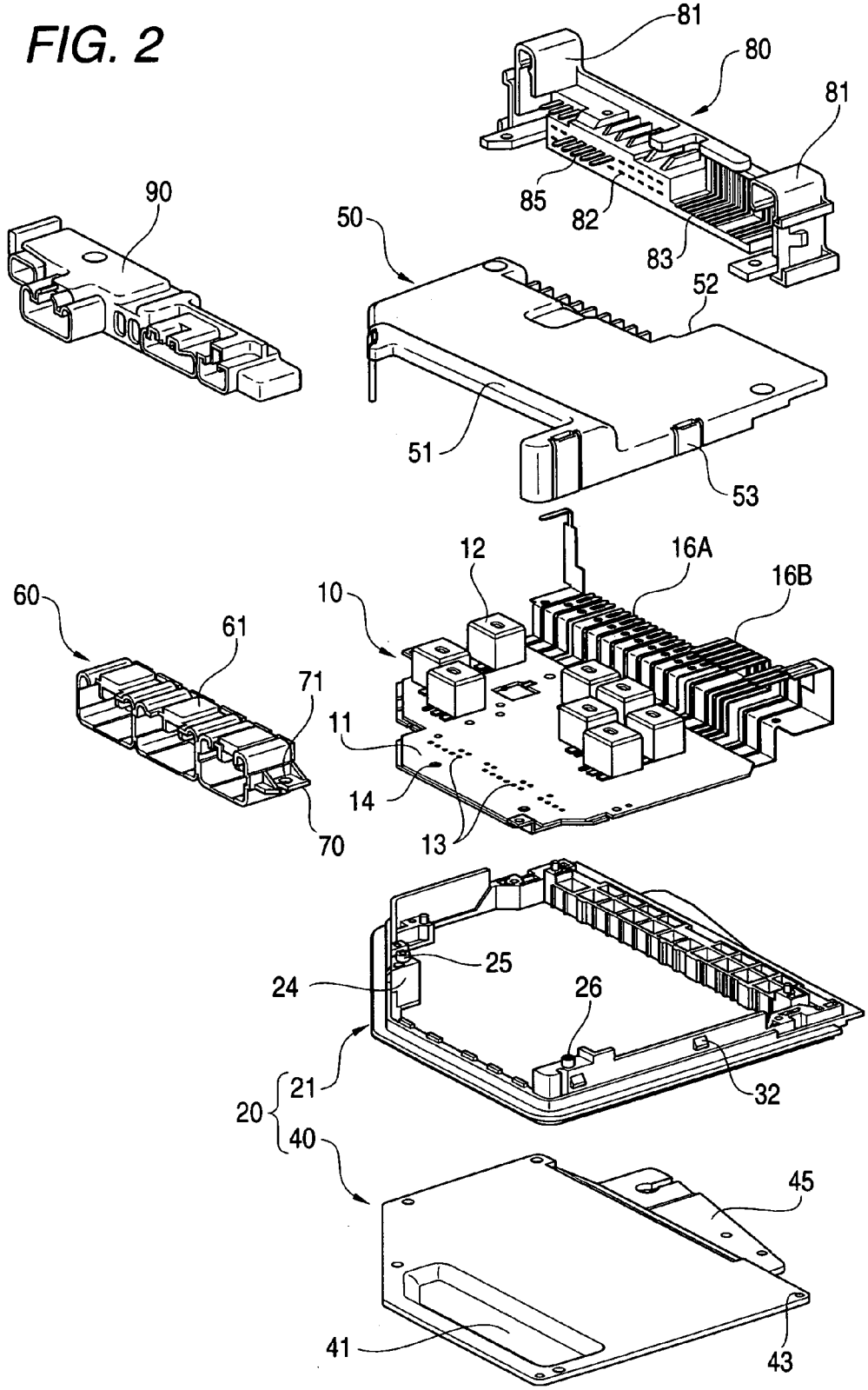
FIG. 2 is an exploded perspective view.

As shown in FIGS. 1 and 2, the electrical connection box of the present embodiment is formed of a circuit forming board 10, a case 20 made of a frame 21 for containing this circuit forming board 10 and a heat radiating plate 40, and a cover 50, and in addition, is formed so that a PCB connector 60 and a fuse box 80 can be mounted. Here, another relay connector 90 is engaged in the fuse box 80.

In the following, the respective component members are described, with the front on the front left side and the rear on the rear right side in FIG. 2.

Figure 3:
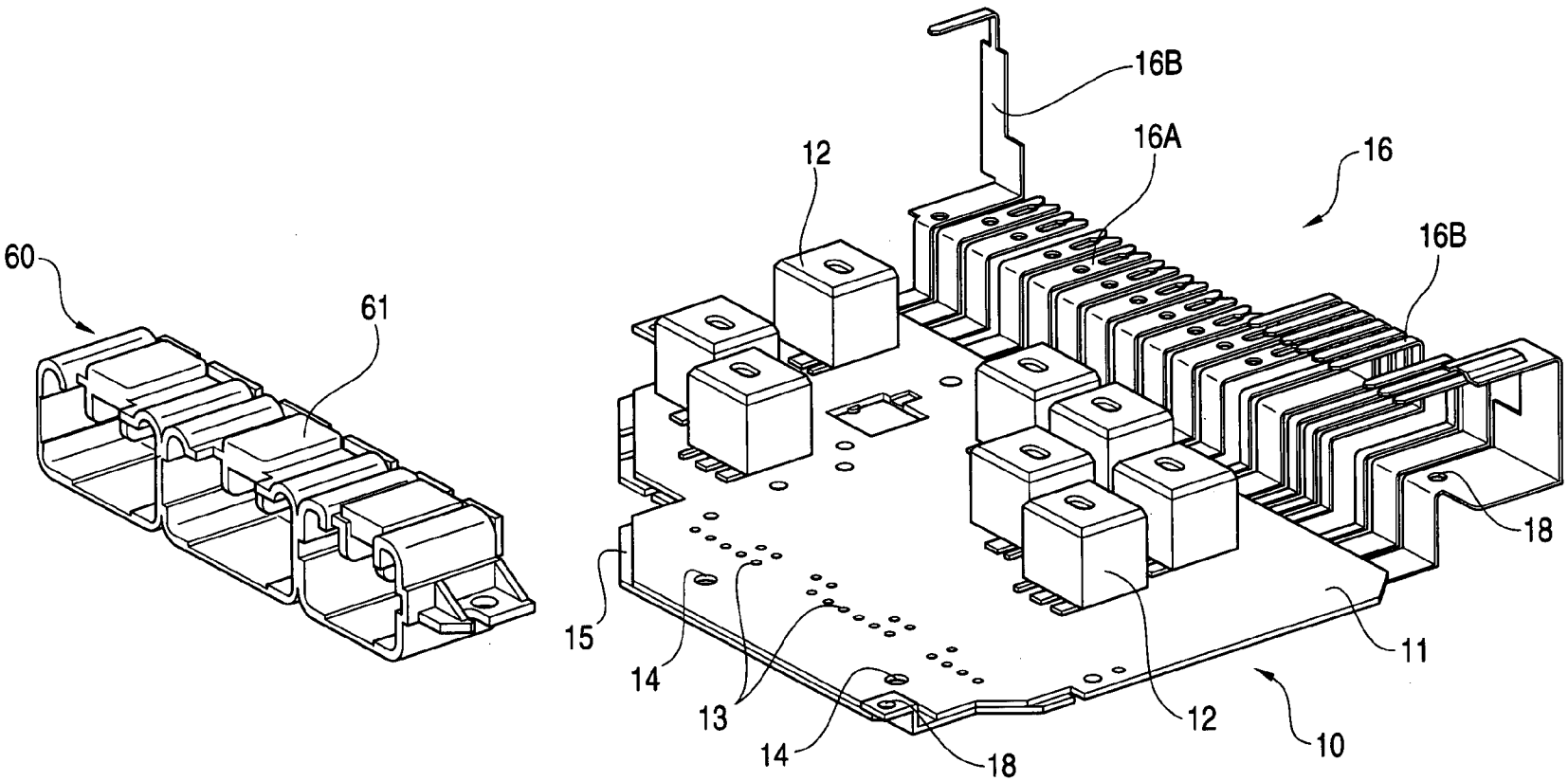
FIG. 3 is a perspective view showing the state before the PCB connector is mounted on the circuit forming board.

As shown in FIG. 3, the circuit forming board 10 is formed of a printed circuit board 11 (hereinafter referred to as circuit board 11) and a bus bar substrate 15 that is placed on the rear surface side of circuit board 11, and is formed so that electrical parts 12, such as relays, can be mounted on the front surface side.

The circuit board 11 is formed with an external shape where the corner on the front left side is cut off from a rectangle, and conductive paths in predetermined patterns are formed on the two sides, front and rear. In addition, through holes 13 for the insertion of male terminals 62 (see FIG. 4) of PCB connector 60 are created on the front side of circuit board 11.

The bus bar substrate 15 is formed by punching out a metal plate having excellent conductivity, and is formed with an external shape which approximately matches the circuit board 11, and predetermined conductive paths that become a power circuit are formed, where a number of bus bars 16 are aligned so as to protrude from the rear end. Bus bars 16A which are aligned along the left region, excluding the leftmost one as viewed from the front, from among the bus bars 16, are bent twice at right angles on the front surface side of the circuit board 11, and thereby, the ends laterally protrude to the rear, and slits for inserting fuses are created at the ends. In addition, the remaining bus bars 16B are bent twice at right angles, and thereby, the ends laterally protrude to the front. Here, window holes 17 (see FIG. 4)

open in the regions of the bus bar substrate 15 that correspond to the regions of circuit board 11 where through holes 13 are formed.

The circuit board 11 and the bus bar substrate 15 are made to adhere to each other via a thin adhesive sheet (not shown) having insulating properties, so as to be integrated.

Figure 4:
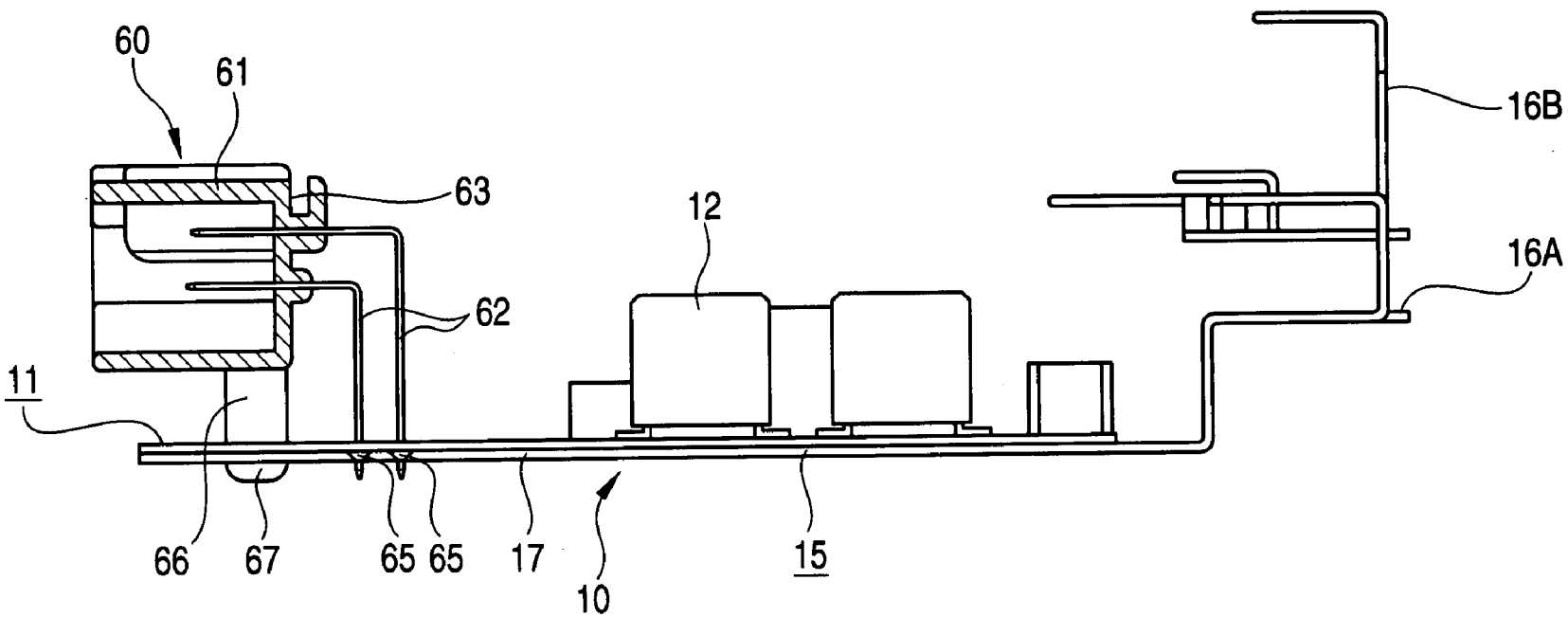
FIG. 4 is a cross sectional side view showing a portion of an electrical connection box in a state where the PCB connector is mounted on the circuit forming board.

As shown in FIG. 4, the PCB connector 60 is provided with a housing 61 made of a synthetic resin which is laterally long and opens on the front, and male terminals 62 that have been formed and bent into an L shape are attached to this housing 61 and aligned in two rows, in a state where one end protrudes into the opening and the other end passes through the rear wall 63 and protrudes downward. The ends of the respective male terminals 62 which protrude downward are inserted into the through holes 13 which open in the circuit board 11 from above, and are connected to the land portions that have been formed around the through holes 13 on the rear surface side, by soldering (soldered portions 65). In addition, a pair, left and right, of attachment legs 66 is formed on the rear surface of the PCB connector 60 on the rear end side. These attachment legs 66 are placed on the surface of the circuit forming board 10 and secured by tapping screws 6, which pass through insertion holes 14 from the lower surface side and are screwed.

The entirety of the case 20 is formed in a shallow dish form so as to contain the circuit forming board 10, and has a structure where a heat radiating plate 40 is engaged with the bottom side of the frame 21 which corresponds to the surrounding wall.

Figure 5:
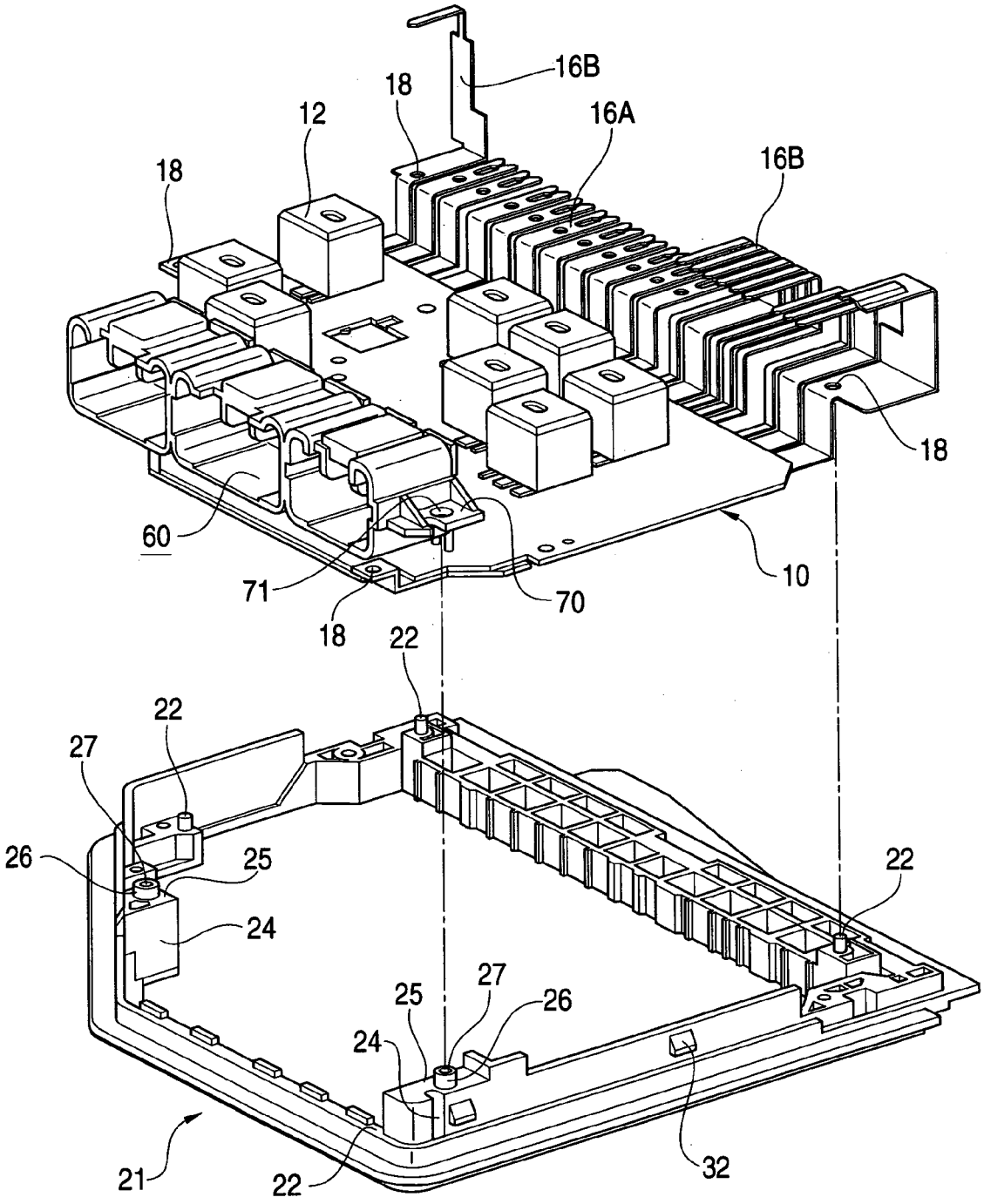
FIG. 5 is a perspective view showing the operation of fitting of the circuit forming board into the frame.
Figure 7:
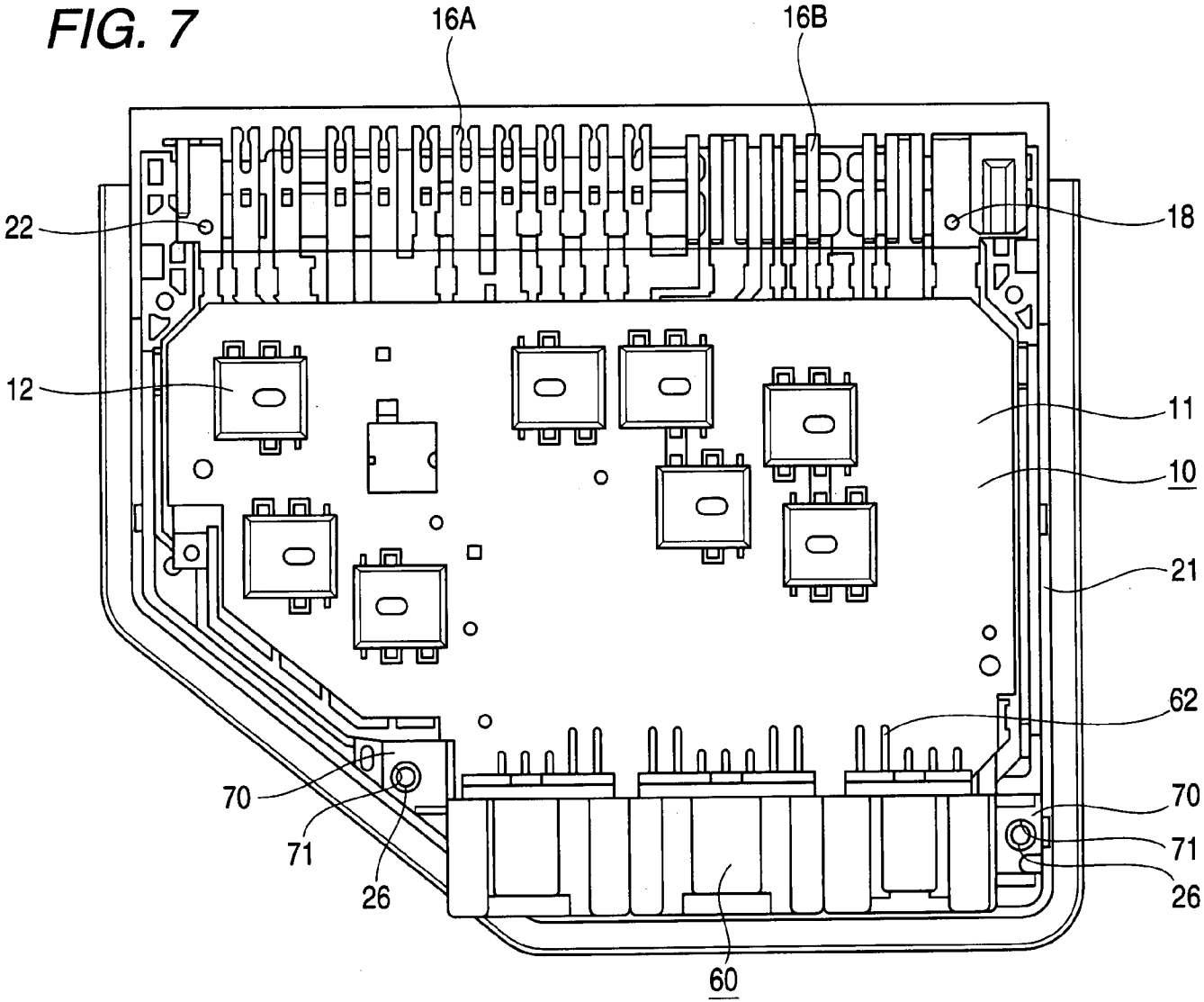
FIG. 7 is a plan view showing the circuit forming board in a state of engagement with the frame.

The frame 21 is made of a synthetic resin and formed, as shown in FIGS. 5 and 7, in a shape where the circuit board 11 and bus bar substrate 15 can be relatively tightly fitted into the inside.

Positioning pins 22 are made to stand on the upper surface of four corners of the frame 21. Positioning holes 18 into which the positioning pins 22 are to be fit are opened in corresponding positions of the bus bar board 15 and bus bars 16 of the circuit forming board 10.

Figure 8:
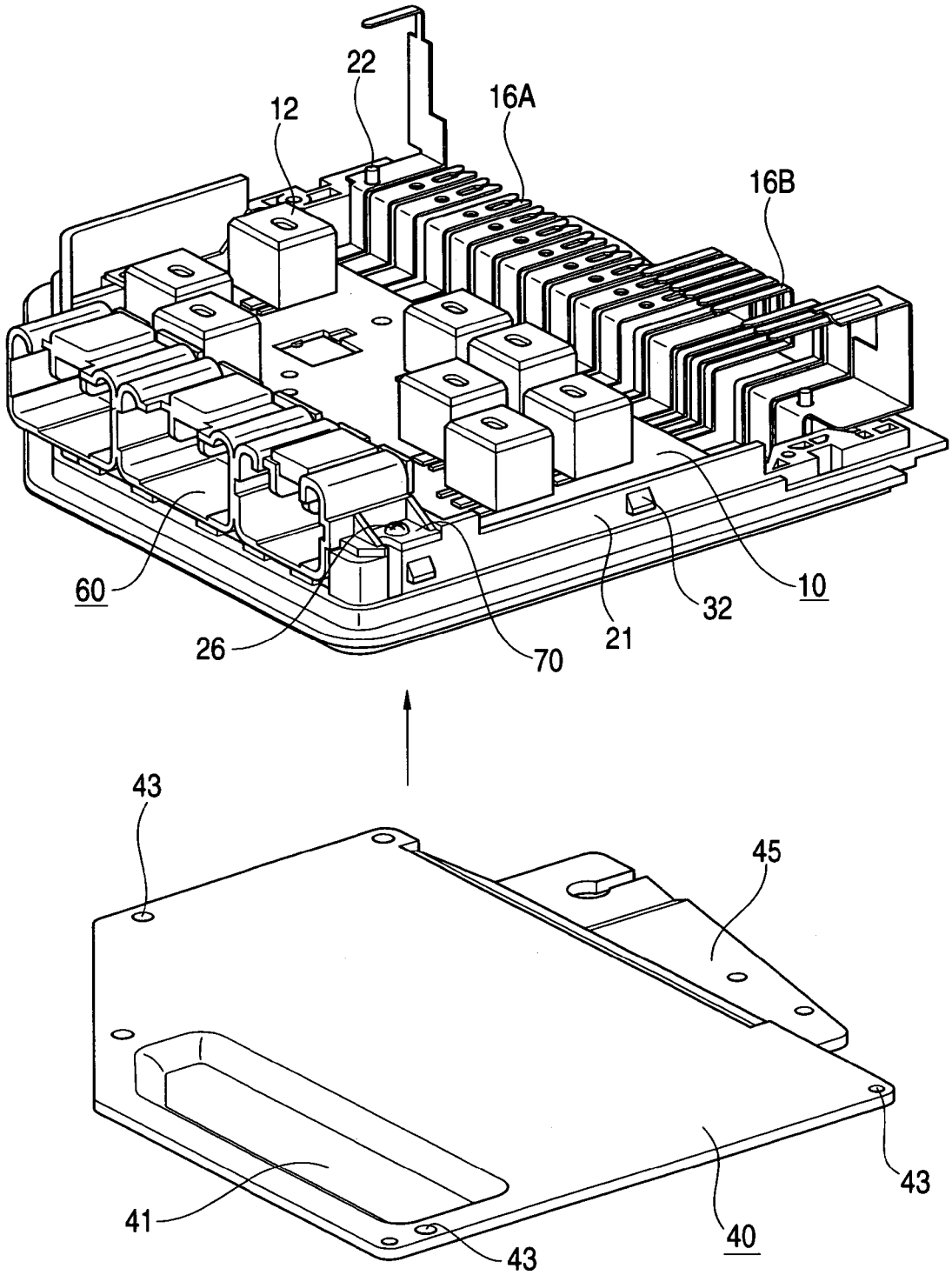
FIG. 8 is a perspective view showing the operation of attaching the heat radiating plate to the lower surface of the frame.

The heat radiating plate 40 is provided in order to radiate heat that is generated in the electrical parts 12, and is formed of a metal plate, such as aluminum, having high heat conductance, in a form which is approximately the same as the outer shape of the frame 21, as shown in FIG. 8. An escape recess 41 is formed on the front portion side of the heat radiating plate 40, in order to avoid interference with the ends of male terminals 62 that have been attached to the PCB connector 60 and protrude from the lower surface side of circuit board 11. Penetrating holes 43 for the tapping screws 42 (FIG. 10) are formed at appropriate intervals in the periphery of the heat radiating plate 40, and the peripheral portion of the heat radiating plate 40 is fitted into the lower surface of the frame 21 and secured with the tapping screws 42 that have been screwed. Meanwhile, the bus bar board 15 of circuit forming board 10 is made to adhere to the upper surface of the heat radiating plate 40 by an insulating adhesive 44 (see FIG. 9).

Here, an attachment piece 45 is formed on the rear end of the heat radiating plate 40 in a state of outward and diagonally downward protrusion.

Figure 6:
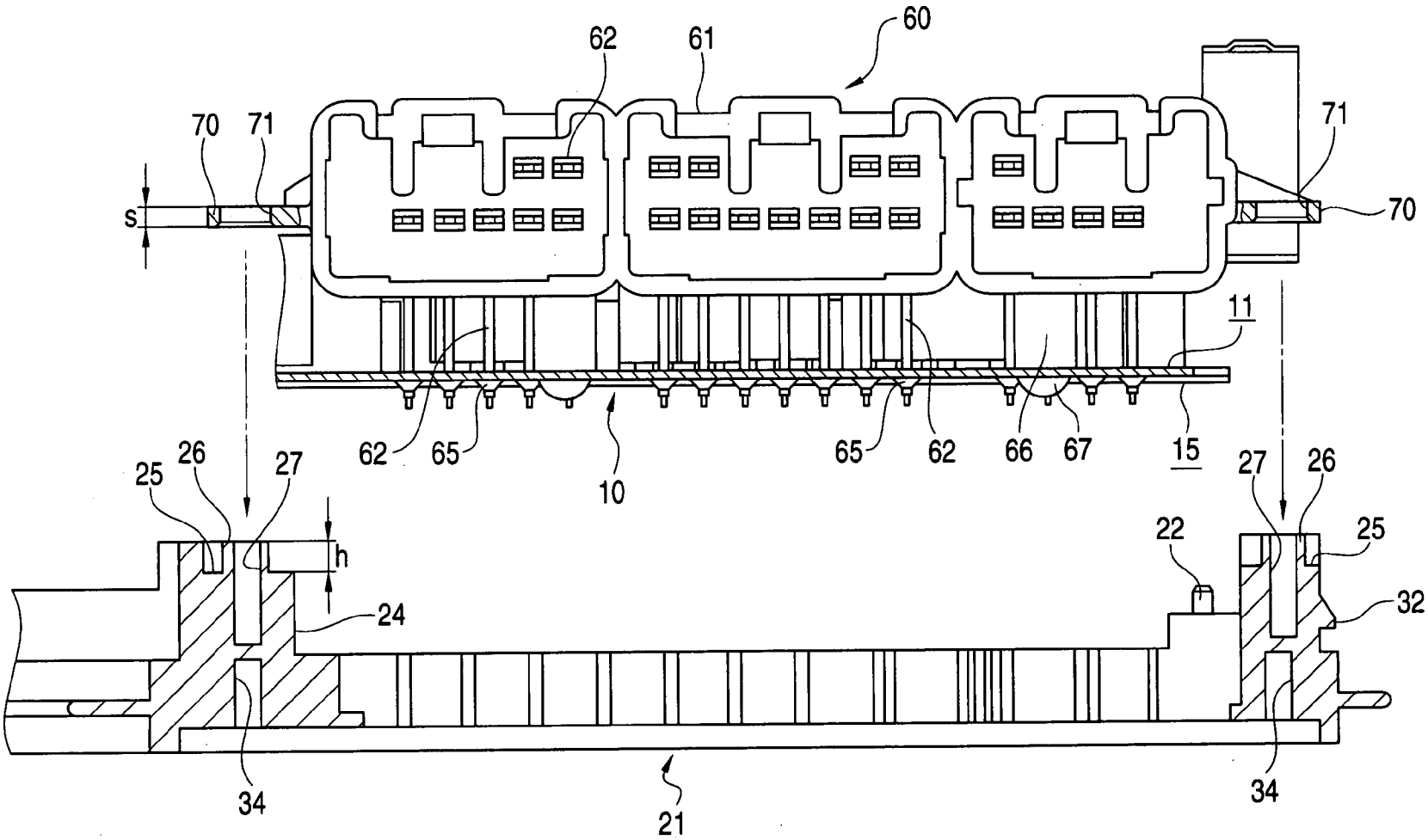
FIG. 6 is a cross sectional front view showing a portion of FIG. 5.

Here, the PCB connector 60 that has been mounted on the circuit forming board 10 is placed along a region on the front end side of the frame 21 of the case 20, specifically, a region from the right end of the front end to a portion that is slightly on the diagonal portion where the left corner is cut off, as shown in FIG. 7, and thus, is secured. Therefore, as shown in FIGS. 5 and 6, a pair of attachment supports 24 are formed in the positions inside the front end of frame 21 which correspond to the two ends, left and right, of the mounting region. The attachment surface semiconductor substrate 25, which are upper surfaces of these attachment supports 24, are formed at the same level.

Figure 10:
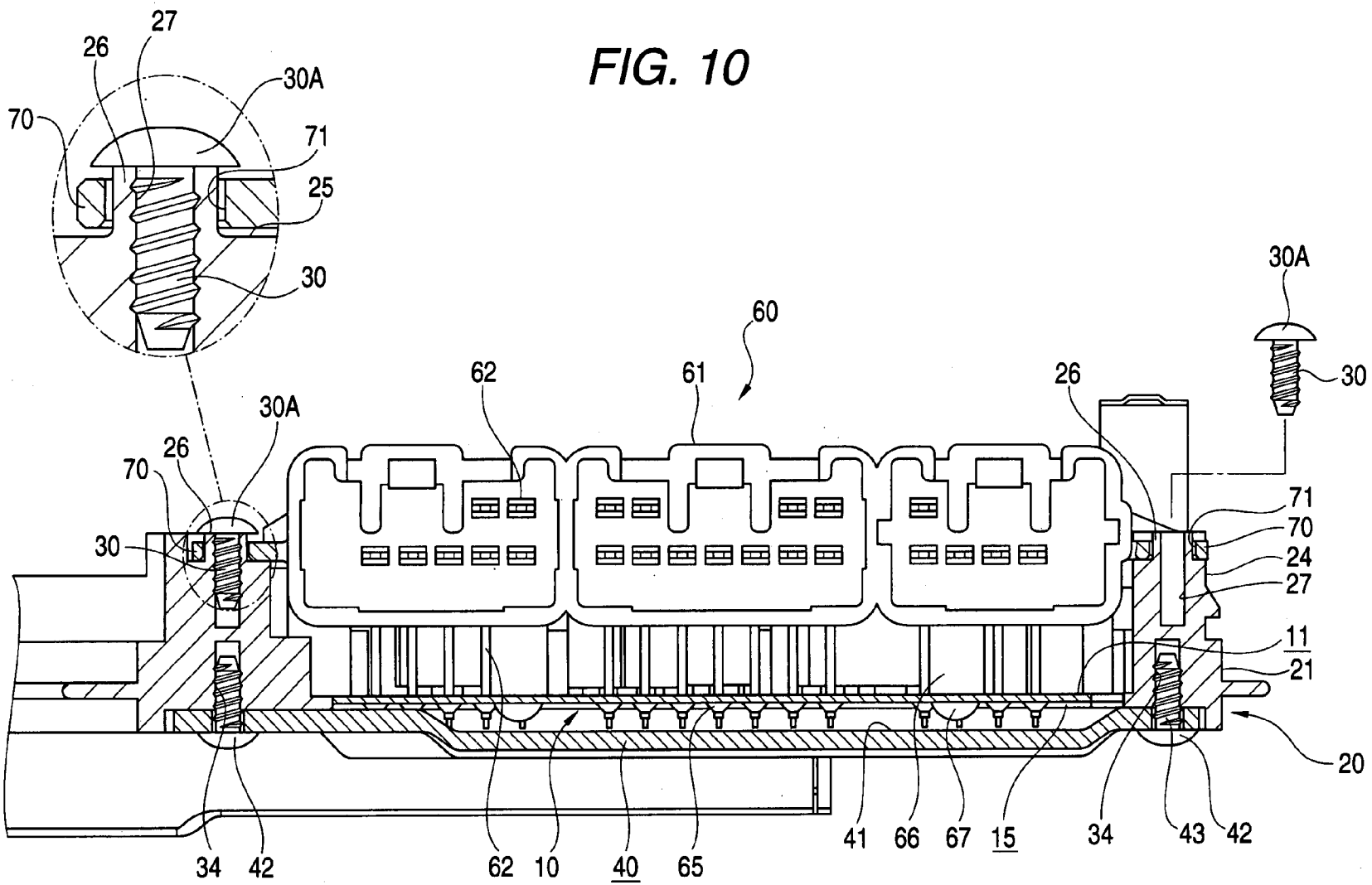
FIG. 10 is a cross sectional front view showing a portion of the PCB connector during the operation of securing the PCB connector to the frame.
Figure 11:
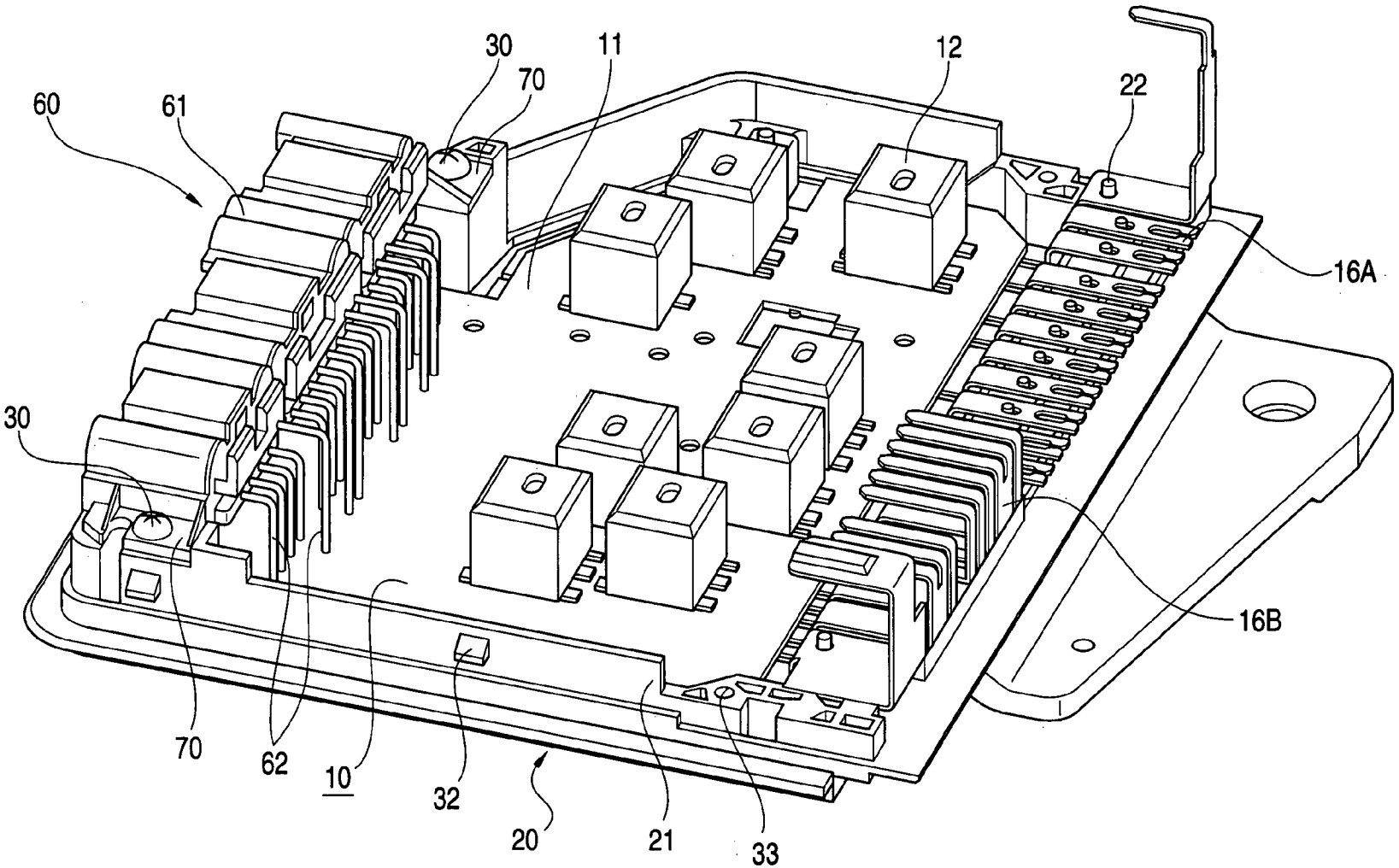
FIG. 11 is a perspective view of the rear side of the PCB connector in a state where the PCB connector is secured to the frame.

Fitting protrusions 26 in short columnar form are formed on the respective attachment surfaces 25. Screw holes 27 (downward holes) are formed in the upper surfaces of the fitting protrusions (attachment member) 26, in the downward direction. Tapping screws (attachment means according to the present invention) 30 with heads (pull-out preventing portion) 30A can be screwed into these screw holes 27, as shown in FIG. 10. The tapping screws 30 can be screwed until the lower surfaces of heads 30A hit the upper surfaces of fitting protrusions 26, and heads 30A have a diameter that is greater than those of fitting protrusions 26.

Here, as shown in FIG. 10, screw holes 34 (downward holes) into which tapping screws 42 are screwed in order to connect the heat radiating plate 40 to the frame 21 are formed in the frame 21 along approximately the same axis as the screw holes 27. It is necessary to form the portions where the screw holes 27 and screw holes 34 are formed so that they are thicker than the other portions of the frame 21, and therefore, the frame can be prevented from being enlarged in the direction of the width, by forming the screw holes 27 and screw holes 34 along approximately the same axis.

Meanwhile, as shown in FIG. 6, attachment plates 70 are formed in and protrude from the positions which are approximately the center of the left and right sides of a housing 61 of the PCB connector 60. Through holes (attachment member) 71 into which the fitting protrusions 26 can be fitted with a slight clearance in the direction of the diameter are formed in the respective attachment plates 70, and thus, a state where there is a clearance is provided. The corners of the through holes 71 on the lower side are rounded for guidance, and heads 30A of the tapping screws 30 stop at the corners of these through holes 71, on the upper side.

Here, it should be noted that the plate thickness s of the attachment plates 70 is set to a value that is smaller than that of the height h of the fitting protrusions 26 by a predetermined value. In other words, in the case where the fitting protrusions 26 are fitted into the through holes 71 so that the lower surfaces of the attachment plates 70 hit the attachment surfaces 25, a clearance of the above-described predetermined value is secured between the corners of through holes 71 on the upper side and the heads 30A of the tapping screens 30 that have been screwed to the maximum into the fitting protrusions 26, according to this setting, and thus, a state where there is a clearance is provided.

In addition, a measure for enhancing the holding force of the PCB connector 60 in the case where an opposing connector is engaged with and removed from the PCB connector is taken using a cover 50.

Figure 12:
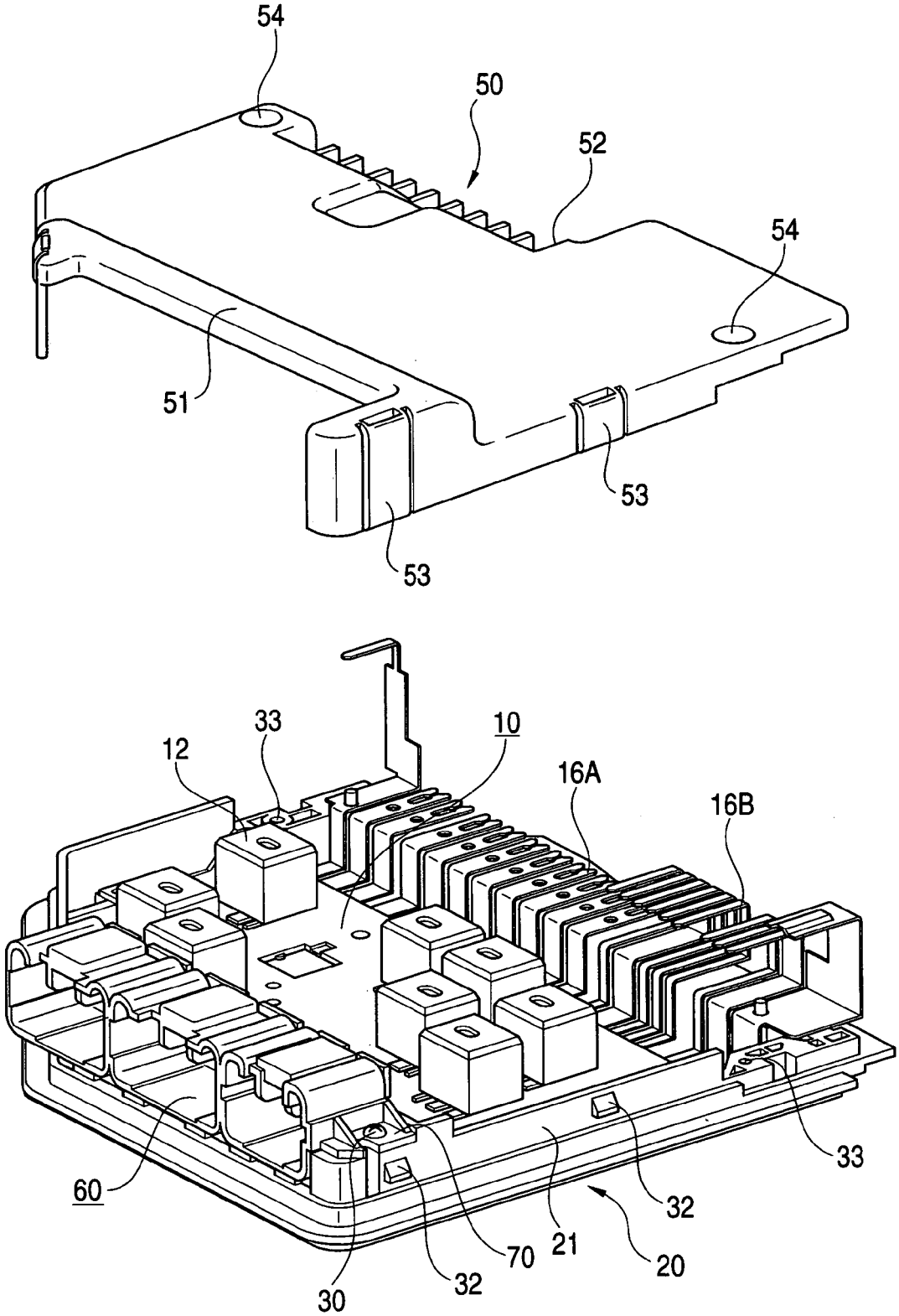
FIG. 12 is a perspective view showing the operation of attaching the cover.
Figure 13:
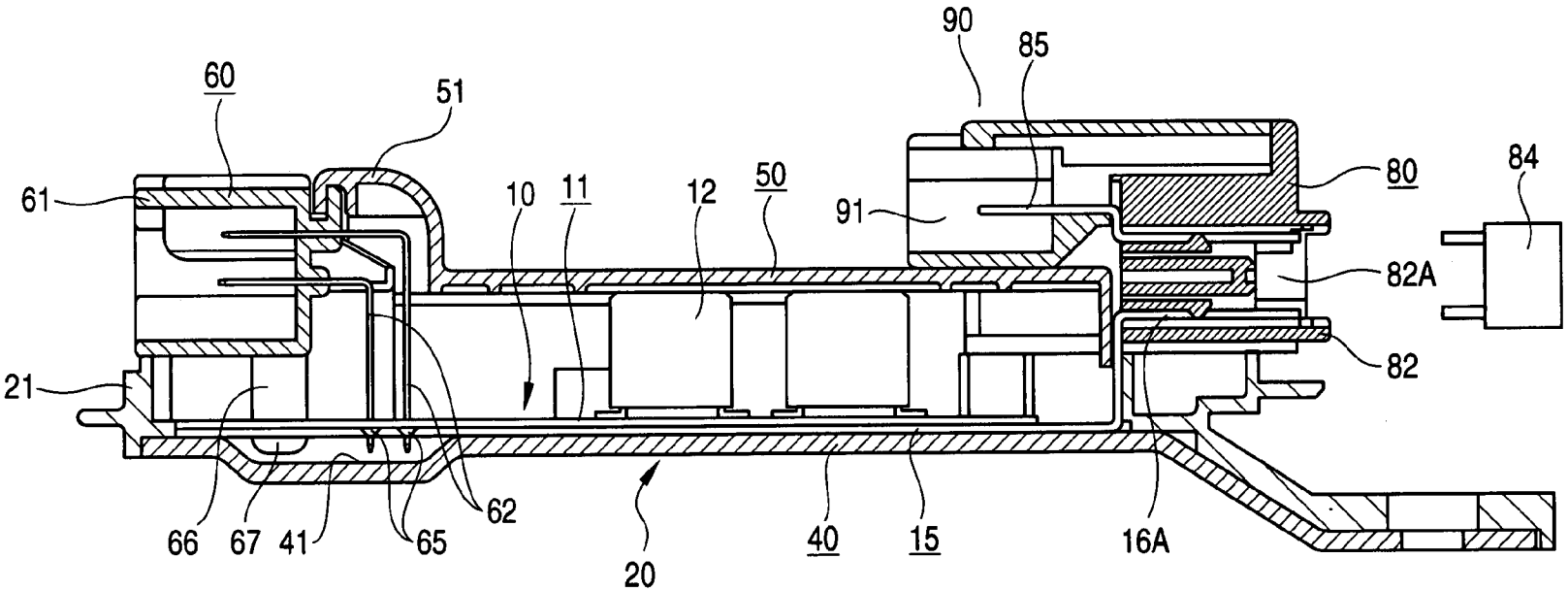
FIG. 13 is a cross sectional side view of the cover in the attached state.

The cover 50 is made of a synthetic resin, and can be attached so as to almost completely cover the opening on the upper surface of the case 20, as shown in FIGS. 12 and 13, and a high level portion 51 for covering the rear surface side of the PCB connector 60 is formed on the front end side, while an escape recess 52 for partially leading out the fuse box 80 that has been fitted in is formed on the rear end surface. Locking pieces 53 which are flexible are provided on the left and right sides of the cover 50, while the locking protrusions 32 which engage with and temporarily hold the locking pieces 53 are provided on the left and right sides of the frame 21. In addition, recesses 54 for the attachment of tapping screws (not shown) are provided in the two end portions on the rear end side of the cover 50, and the screws can be screwed into screw holes 33 (downward holes) that have been provided in the upper surfaces of the left and right side walls of the frame 21.

The fuse box 80 is made of a synthetic resin and formed in a laterally long form so as to cover the rear surface side of frame 21 along the entirety of the length, as shown in FIG. 2, and connector parts 81 having an opening in the front are provided to the two end portions in the direction of the length, and in addition, a fuse attachment part 82 is provided to the left and a terminal containing part 83 is provided to the right, respectively, between the two end portions as viewed from the front.

A number of attachment holes 82A to which fuses 84 are attached are provided in the fuse attachment part 82 so as to open on the rear surface side, as shown in FIG. 13, and a bus bar 16A is attached to the lower side of each attachment hole 82A by compressive insertion so that the end faces backward, and a connection terminal 85 in tab form which makes a pair with this bus bar 16 is attached to the upper side in the same manner, by compressive insertion, while the front end of the connection terminal 85 in tab form is formed so as to be bent in a crank form and protrudes to the front. Meanwhile, the bus bars 16B of which the ends face the front are contained in connector parts 81 and terminal containing parts 83.

A relay connector 90 can be coupled to the front surface of the region that ranges from the fuse attachment part 82 and terminal containing part 83 in the fuse box 80, and the upper sides of the connection terminals 85 and the bus bars 16B that protrude to the front from the fuse attachment part 82 and the terminal containing part 83 enter into an engagement portion 91 which opens in the front portion of the relay connector 90.

Next, an example of a manufacturing process for an electrical connection box is described. A bus bar substrate 15 is formed by carrying out a pressing process on a metal plate material, and the circuit board 11 is made to adhere to the upper surface of this bus bar substrate 15 via an insulating adhesive sheet (not shown) so as to be integrated, and thus, the circuit forming board 10 is formed. At this time, the bus bars 16 that protruded from the rear end of the bus bar substrate 15 are bent and processed into the above-described form. After that, the electrical parts 12 are mounted on the conductive paths of the circuit board 11 and bus bar substrate 15 by reflow soldering.

Next, as shown in FIG. 3, the PCB connector 60 is placed on the front end side of the surface of circuit board 11, and at the same time, protruding ends of the male terminals 62 that face downward are made to penetrate through corresponding through holes 13 of the circuit board 11. Subsequently, as shown in FIG. 4, the attachment legs 66 that are placed on the surface of the circuit board 11 are secured by tapping screws 67. After that, male terminals 62 are connected to the land portions formed around the through holes 13 on the rear surface side by flow soldering (soldered portions 65).

As described above, the circuit forming board 10 on which the PCB connector 60 has been mounted is assembled from the above into the frame 21, as shown in FIG. 5. At this time, the positioning pins 22 that have been provided to the upper surface of the frame 21 are inserted for positioning into the positioning holes 18 that have been formed in the bus bar substrate 15 and bus bars 16. In addition, as shown in FIGS. 6 and 7, the fitting protrusions 26 that stand on the attachment surface 25 of the frame 21 are fitted into the through holes 71 that open in the attachment plates 70 on the left and on the right of the PCB connector 60.

Figure 9:
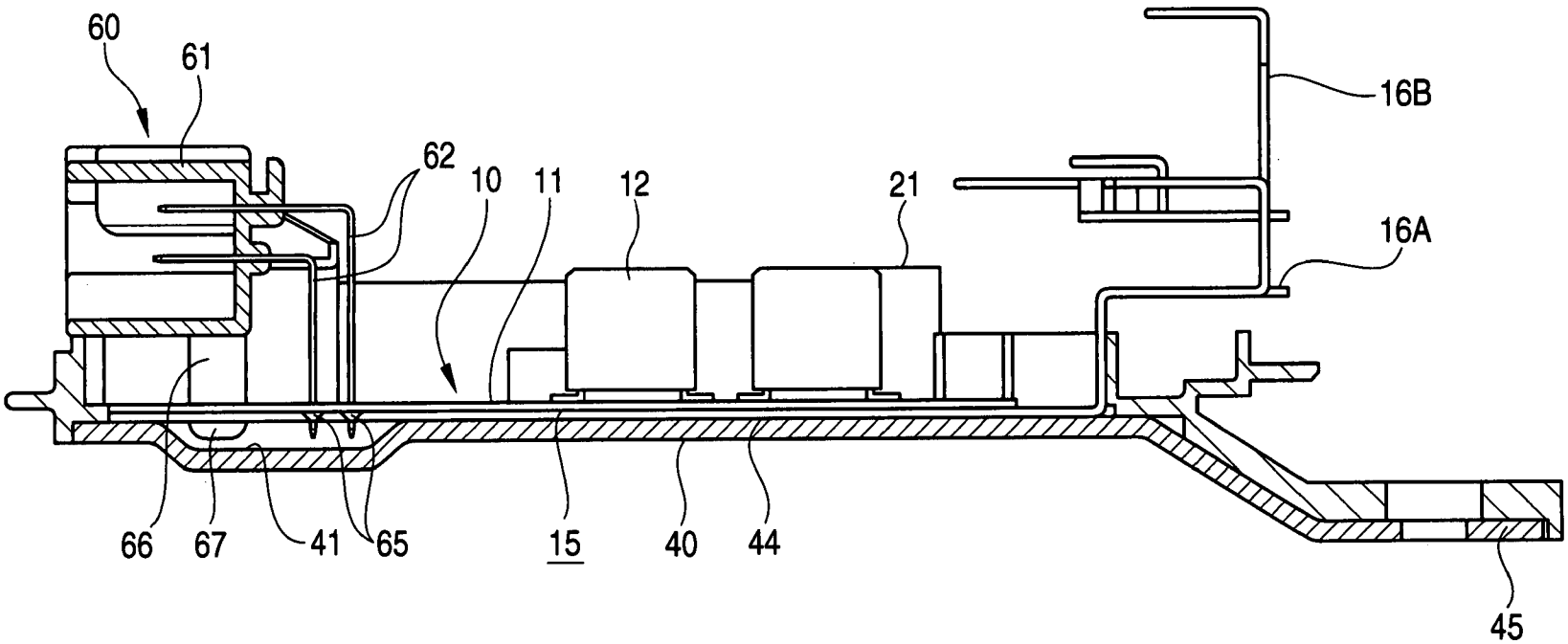
FIG. 9 is a cross sectional side view of the frame in a state where a heat radiating plate has been attached to the lower surface.

Next, the insulating adhesive 44 is applied to the entirety of the upper surface of the heat radiating plate 40, and, as shown in FIGS. 8 and 9, the heat radiating plate 40 is made to adhere to the lower surface of the bus bar substrate 15 and the lower surface of the frame 21 in the circuit forming board 10. After that, as shown in FIG. 10, the tapping screws 42 are inserted into the penetrating holes 43 which open in the periphery of the heat radiating plate 40 and secured by being screwed into the screw holes 34 (downward holes) that have been formed in the lower surface of frame 21. As a result of this, the circuit forming board 10 is secured to the case 20.

Subsequently, the PCB connector 60 is secured to frame 21. Namely, as shown at the right side of FIG. 10, the tapping screw 30 with the head 30A is screwed into the screw hole 27 in the fitting protrusion 26 which is engaged with the through hole 71 of the attachment plate 70 of the PCB connector 60. The tapping screw 30 is screwed until the lower surface of the head 30A hits the upper surface of fitting protrusion 26, as shown at the left side of this figure, in a manner where the head 30A of the tapping screw 30 stops at the end of the through hole 71 on the upper side of the attachment plate 70, preventing the attachment plate from coming off.

Here, in the case where, for example, the PCB connector 60 is shifted in position in the direction where it is lifted from the circuit forming board 10 and attachment plate 70 is simply screwed to the attachment surface 25, the front end side of the PCB connector 60 that is not supported by the attachment leg 66 is displaced in a manner where it sinks when the form of the male terminals 62 is elastically changed.

In the present embodiment, however, the plate thickness s of the attachment plates 70 is set at a value that is smaller than that of height h of the fitting protrusions 26, and therefore, even in the case where the PCB connector 60 is shifted in a position in the direction where it is lifted from the circuit forming board 10, clearances still remain between the heads 30A of the tapping screws 30 and the ends of the through holes 71 so that a state where there is a clearance is provided, as shown in the enlarged view of FIG. 10, and thus, the attachment plate 70 is not forced down. That is to say, the PCB connector 60 can be prevented from being displaced downward when the form of the male terminals 62 is elastically changed, and as a result, the occurrence of remaining stress can be prevented in the portions 65 where the male terminals 62 have been soldered to the through holes 13 of the circuit board 11. Accordingly, the soldered portions 65 can be prevented from being damaged, for example, cracked.

When screwing in the PCB connector 60 is completed, a potting agent, such as a gel (not shown), is put into the frame 21, so that the surface of the circuit board 11 is coated with the potting agent, and thus, water repelling properties are secured.

After that, as shown in FIG. 12, the PCB connector is covered from above with the cover 50. The cover 50 is pressed while the form of the locking pieces 53 is being elastically changed, and when the cover is pushed into a normal position, the locking pieces 53 elastically engage with the locking protrusions 33 that have been provided in the frame 21. Then, the tapping screws that have been placed into the attachment recesses 54 on the two end portions, left and right, on the rear end side of the cover 50 are screwed into and secured to the screw holes 33 that have been provided in the upper surface of the left and right side walls of the frame 21.

Subsequently, the fuse box 80, to which the connection terminals 85 have been attached in advance, is assembled into the rear end of the case 20.

Accompanying the assembly of the fuse box 80, the bus bars 16A, which are provided so as to protrude from the bus bar substrate 15, enter into and are attached to the lower side of the corresponding attachment holes 82A in the fuse attachment part 82, as shown in FIG. 13. In addition, the bus bars 16B of which the ends face the front are contained in the terminal containing part 83 and connector parts 81. Finally, the relay connector 90 is engaged with the front surface of the fuse box 80, and thus, an electrical connection box as that shown in FIG. 1 is completed.

In this electrical connection box, the fuses 84 are attached from the rear surface to the respective attachment holes 82A of fuse attachment part 82. In addition, opposing connectors (not shown) are engaged from the front surface with the PCB connector 60 and relay connector 90. In addition, this electrical connection box is contained within the casing of a relay box, in a state where it is placed in the longitudinal direction with the PCB connector 60 facing downward, and attached in this state to a car panel in the engine room on the fender side via the attachment piece 45 of the heat radiating plate 40.

As described above, in accordance with the present embodiment, the plate thickness s of the attachment plate 70 is set at a value that is smaller than the protrusion height h of the fitting protrusions 26 in the portions where the attachment plate 70 of the PCB connector 60 is fitted into and screwed to the fitting protrusions 26 on the frame 21 side. As a result of this, even in the case where the PCB connector 60 is shifted in position from the circuit forming plate 10 in the direction in which it is lifted off, a clearance still remains between the heads 30A of tapping screws 30 and the ends of the through holes 71, and thus, a state of attachment with a clearance is maintained, and therefore, the attachment plate 70 is not forcefully pressed against the frame. That is to say, the PCB connector 60 is prevented from being displaced downward when the form of the male terminals 62 is elastically changed, and thereby, residual stress can be prevented from remaining in the portions 65 where male terminals 62 are soldered to the through holes 13 of the circuit board 11. Accordingly, the soldered portions 65 can be prevented from being damaged, for example, cracked. Thus, high reliability can be obtained in the electrical connection between the PCB connector 60 and circuit forming plate 10.

<Embodiment 2 >

Embodiment 2 of the present invention is described with reference to FIG. 14. This Embodiment 2 shows an electrical connection box where the screw insertion holes 28 for inserting the tapping screws 30 are formed on the end surfaces of the fitting protrusions 26. Here, the other portions of the structure and working effects are the same as those of the above-described Embodiment 1, and therefore, the same symbols are attached to parts that are the same as those of Embodiment 1, and descriptions that are the same are omitted.

Figure 14:
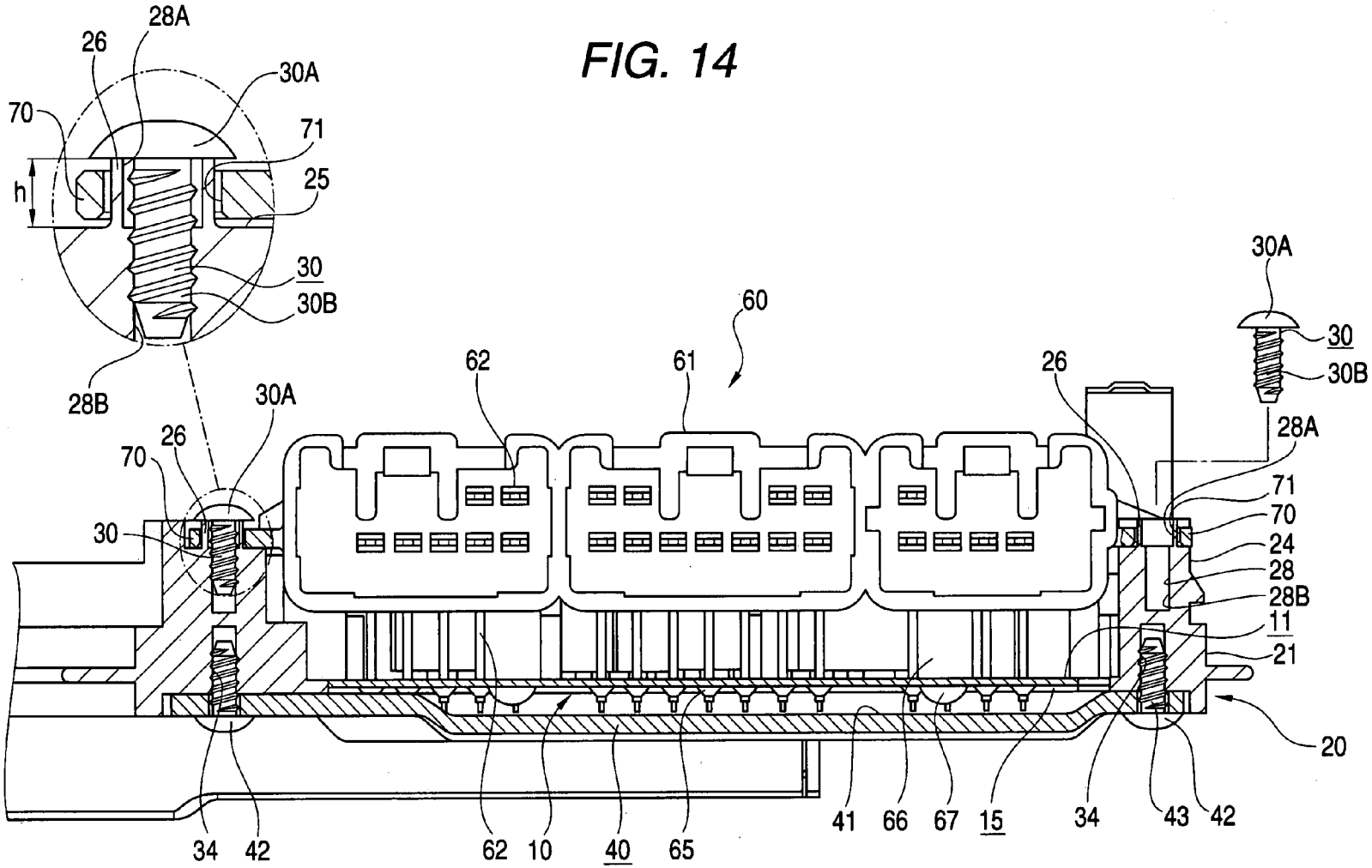
FIG. 14 is a cross sectional front view showing a portion of an electrical connection box according to Embodiment 2 during the operation of securing the PCB connector to the frame.

As shown at the right side of FIG. 14, the screw insertion hole 28 is formed downward from the upper surface of a fitting protrusion 26. In this screw insertion hole 28, the screw escape portion 28A where the inner diameter of the screw insertion hole 28 is set so as to be greater than the outer diameter of the greatest portion of a threaded portion 30B of the tapping screw 30 is formed starting from the upper surface of the fitting protrusion 26, as deep as height h of the fitting protrusion 26. The inner diameter of the region that is deeper than screw escape portion 27A in the screw insertion hole 28 is set at a value smaller than the inner diameter of the screw escape portion 27A, and forms a screw hole 28B (downward hole) into which the threaded portion 30B of the tapping screw 30 is screwed. The screw escape portion 28A and screw hole 28B are formed along the same axis.

When the PCB connector 60 is secured to the frame 21, as shown at the right side of FIG. 14, the tapping screw 30 with the head 30A is inserted into the screw insertion hole 28 of the fitting protrusion 26, which is fitted into the through hole 71 of the attachment plate 70 of the PCB connector 60. The inner diameter of the screw escape portion 28A is set at a value that is greater than the outer diameter of the greatest portion of the threaded portion 30B of the tapping screw 30, and therefore, the tapping screw 30 does not make contact with the inner surrounding wall of the screw escape portion 28A.

As the end of the threaded portion 30B of the tapping screw 30 reaches the lower end of the screw escape portion 28A, the tapping screw 30 is screwed into the screw hole 28B. The screw insertion hole 28 is formed in fitting protrusion 26, and thereby, the walls are thin, and cracking easily occurs, in comparison with a case where the screw insertion hole 28 is not formed. In view of this, the tapping screw 30 is made not to make contact with the inner surrounding wall of the screw escape portion 28A in the present embodiment. As a result of this, no force is applied to the fitting protrusion 26 from the tapping screw 30 when the tapping screw 30 is screwed into the screw hole 28B, and therefore, cracking of the fitting protrusion 26 can be prevented.

<Other Embodiments>

The present invention is not limited to the embodiments which are described in the above with reference to the drawings, but rather, the following embodiments, for example, are also included in the technical scope of the present invention, and a variety of modifications, in addition to the following embodiments, can be implemented within a scope which does not deviate from the spirit of the present invention.

(1) A screw with a head may be directly screwed into the attachment surface through a through hole of the attachment plate of the PCB connector in a portion where the attachment plate is screwed to the attachment surface, and at this time, the amount of screwing is restricted, and thereby, a predetermined clearance may be provided between the head of the screw and the end of the through hole, according to the setting.

(2) Instead of screwing a screw with a head, a pin with a head may be driven in.

(3) The means for connecting the terminal fitting silicon oxide film the PCB connector to the conductive paths of the circuit forming board may be surface mounting using reflow soldering. This is also included in the technical scope of the present invention.

(4) Though the bottom plate of the case is formed of a heat radiating plate in the above-described embodiments, the bottom plate of the case may be separately formed of the heat radiating plate.

(5) Though the head of a tapping screw is used as a pull-out preventing portion according to the above-described embodiments, a pull-out preventing portion may be formed by applying heat and pressure to the end of a fitting protrusion so that the end of the fitting protrusion has a diameter that is greater than the inner diameter of a through hole after the fitting protrusion is made to pass through the through hole.

(6) The attachment means may have a configuration provided with fitting protrusions formed on the connector, through holes which are formed in the frame and through which the fitting protrusions pass, and pull-out preventing portions which are provided to the ends of fitting protrusions after the fitting protrusions are made to pass through the through holes and which are formed so as to have a diameter that is greater than the inner diameter of a through hole.

What is claimed is:

1. An electrical connection box comprising:

a case housing a circuit forming board having a conductive path, the case having a first attachment member;

a connector being mounted on the circuit forming board, the connector having a second attachment member; and a terminal fitting being attached to the connector and connected to the conductive path of the circuit forming board by soldering, wherein the connector is attached to the case with a clearance with respect to the case by the first and second attachment members.

2. The electrical connection box according to claim 1, wherein the first attachment member includes a fitting protrusion, wherein the second attachment member includes a through hole through which the fitting protrusion of the case can pass, wherein a pull-out preventing portion is at an end of the fitting protrusion after the fitting protrusion has been passed through the through hole, and wherein the pull-out preventing portion has a diameter that is greater than an inner diameter of the through hole.

3. The electrical connection box according to claim 2, wherein the pull-out preventing portion is a head of a screw that has been screwed into an end surface of the fitting protrusion.

4. The electrical connection box according to claim 3, wherein a screw insertion hole for inserting the screw is formed in the end surface of the fitting protrusion, wherein the screw insertion hole is formed on an area that is substantially as deep as a protrusion height of the fitting protrusion from the end surface of the fitting protrusion, and wherein the screw insertion hole has a screw escape portion of which an inner diameter is greater than a maximum outer diameter of the threaded portion of the screw; and a screw hole which is formed at a bottom of the screw escape portion, and in which the screw is screwed.

5. An electrical connection box comprising:

a case having an opening, the case housing a circuit forming board having a conductive path;

a connector being attached to an attachment surface of the case at end side of the opening, the connector being mounted on the circuit forming board;

a terminal fitting being attached to the connector and connected to the conductive path of the circuit forming board by soldering; and an attachment member being provided between the attachment surface of the case and the connector, wherein the attachment member allows a displacement of the connector by pressing the connector against an attachment surface of the case.

6. The electrical connection box according to claim 5, wherein the connector includes an attachment plate pressed against the attachment surface of the case, wherein a head of the screw can be engaged with an end of the through hole by screwing a screw into the attachment surface of the case through a through hole that has been opened in the attachment plate, and wherein a restriction member for restricting a height of the head of the screw is provided in such a manner that a predetermined clearance is provided between the head of the screw and the end of the through hole, even in case where the screw has been screwed to a maximum.

7. The electrical connection box according to claim 6, wherein a fitting protrusion where a screw hole for the screw is threaded into an end surface of the fitting protrusion is provided on the attachment surface of the case, wherein the fitting protrusion can be fitted into the through hole that has been opened in the attachment plate of the connector, wherein the head of the screw that is screwed into the screw hole can be engaged with the end of the through hole, and wherein a plate thickness of the attachment plate is set at a value to be smaller than the height of the fitting protrusion.

* * * * *